United States Patent [19]

Althaus

[11] Patent Number: 5,033,152

[45] Date of Patent: Jul. 23, 1991

[54] WET RAZOR

[75] Inventor: Wolfgang Althaus, Wuppertal, Fed. Rep. of Germany

[73] Assignee: Wilkinson Sword Gesellschaft mit beschränkter Haftung, Solingen, Fed. Rep. of Germany

[21] Appl. No.: 526,814

[22] Filed: May 22, 1990

[30] Foreign Application Priority Data

May 22, 1989 [DE] Fed. Rep. of Germany ... 8906324[U]

[51] Int. Cl.[5] ..... B26B 21/22

[52] U.S. Cl. ..... 30/89; 30/57; 30/85

[58] Field of Search ..... 30/57, 87, 89, 88, 85

[56] References Cited

U.S. PATENT DOCUMENTS

| | | | |
|---|---|---|---|
| 2,059,172 | 10/1936 | Sabiers | 30/87 |
| 2,235,868 | 8/1943 | Morrow | 30/87 |
| 2,239,415 | 4/1941 | Edelheit et al. | 30/85 |
| 4,083,103 | 4/1978 | Estandian | 30/47 |
| 4,573,266 | 3/1986 | Jacobson | 30/41 |
| 4,617,736 | 10/1986 | McCrary | 30/169 |

FOREIGN PATENT DOCUMENTS

| | | |
|---|---|---|
| 946081 | 5/1947 | France . |
| 463265 | 10/1935 | United Kingdom . |

*Primary Examiner*—Douglas D. Watts
*Assistant Examiner*—John M. Husar
*Attorney, Agent, or Firm*—Robert W. Becker & Associates

[57] ABSTRACT

A wet razor having a handle, on the front end of which is disposed a razor head that carries a razor blade, is provided. In the region between the razor head and a grasping portion of the handle, there is provided a turning mechanism via which the razor head, with its razor blade, is freely rotatable relative to the grasping portion of the handle about an axis of rotation that is perpendicular to the cutting edge of the razor blade. Associated with the turning mechanism 5 is a spring-type resetting mechanism via which the razor head, starting from a prescribed starting position and after a limited deflection or travel, can automatically return to the starting position due to spring force.

8 Claims, 2 Drawing Sheets

WET RAZOR

BACKGROUND OF THE INVENTION

The invention relates to a wet razor having a handle, on the front end of which is disposed a razor head that carries a razor blade, whereby in the region between the razor head and the grasping portion of the handle, there is provided a turning mechanism via which the razor head, with its razor blade, is freely rotatable relative to the grasping portion of the handle about an axis of rotation that is perpendicular to the cutting edge of the razor blade.

A wet razor of this type is disclosed in GB-PS 610 997. It has a handle, on the front end of which is rotatably disposed a razor head that carries the razor blade. For this purpose, rotatably mounted within the handle is a shaft on the front end of which is securely disposed the razor head with the razor blade. In order, when necessary during shaving, to be able to preclude the rotational movement of the razor head the handle comprises three sector-like grasping portions that by appropriately tightly grasping the handle can be moved inwardly in such a way that the shaft can no longer turn within the handle.

The primary drawback of the known wet razor with the freely rotatable razor head is that the forces of resistance that occur while shaving lead to a very rapid deflection or travel and hence shifting of the razor head. This does not result in an optimum shave. Furthermore, after the razor head is raised from the surface of the face, it remains in the respective rotated position, so that before a subsequent shaving process can be undertaken, the razor head must first return to its starting position. This takes place when the razor head pivots back as it is pressed upon the surface of the face, which adversely affects the shaving comfort. Alternatively, the user can rotate the handle into the new position, which is similarly bothersome. Finally, the known wet razor with the continuously rotating razor head has the drawback that while shaving, especially in longer passes over the chin, the razor head with the razor blade is turned in such a way that an angle to the direction of movement is established that is dangerous in that a movement component in the direction of the cutting edge of the razor blade results. This movement component can lead to injuries due to cuts if the angle exceeds a critical value.

With this as a starting point, it is an object of the present invention to further develop the known wet razor in such a way that the turning mechanism is improved to avoid the drawbacks of the known razor.

SUMMARY OF THE INVENTION

As a technical approach, a spring-type returning or resetting mechanism that is associated with the turning mechanism is proposed via which the razor head, starting from a prescribed starting position and after a limited deflection or travel, can be automatically reset to the starting position due to the spring force.

The spring-type resetting mechanism that is associated with the turning mechanism has the advantage that the forces of resistance that occur during shaving cannot lead so rapidly to a deflection and shifting of the razor head and hence of the razor blade. This leads on the whole to a very smooth and thorough shave. By means of an appropriate configuration of the spring, a well-defined resetting behavior can be provided, whereby the limit for the torque is preferably between 10 Nmm and 100 Nmm.

The spring-type resetting mechanism furthermore has the advantage that the razor head with the razor blade returns to the prescribed starting position after it is raised from the surface of the face.

Pursuant to one preferred specific embodiment, it is proposed that the deflection or travel be limited by a stop arrangement. In this connection, the travel, starting from the starting position, is preferably limited in both directions of rotation to a maximum of approximately 30°. This has the advantage that no critical movement components in the direction of the razor blade cutting edge result, which could lead to injuries due to cuts. This critical angle is approximately plus or minus 30°, so that for the aforementioned reasons, it is expedient to prevent a movement beyond this angle by means of the inventive stop arrangement. It is to be understood that the angle could also be less than 30°.

Pursuant to one preferred structural embodiment, the grasping portion of the handle is formed by a sleeve that is rotatably mounted on the actual handle, with the spring being supported between the sleeve and the actual handle. Thus, while shaving, the user grasps the sleeve, within which then the actual handle can freely rotate counter to the spring force and can thus optimally adapt to the contour of the face.

The spring is preferably a helical or spiral spring that in the region of the sleeve that forms the grasping portion surrounds the internally disposed actual handle. This represents a technically straight-forward possibility for constructing the spring-type resetting mechanism, whereby via the appropriate configuration of the helical spring, a well-defined spring characteristic can be produced.

In a further specific embodiment, it is proposed that the sleeve be disposed essentially in the central portion of the handle. This means that the actual, rotatable handle is still accessible, especially at the lower end of the handle. This has the advantage that by appropriately grasping not only the sleeve but also this portion of the actual, rotatable handle, the user can effect an arresting action, via which if desired the user can prevent a rotational movement in a simple manner.

Pursuant to one preferred specific embodiment, the turning mechanism is provided in the front portion of the handle. This can be technically realized in an extremely straightforward manner, whereby the front portion of the handle, together with the razor head and its razor blade, are rotatable relative to the rear portion of the handle that is provided with the grasping portion. In this way, a stable connection is provided between the handle and the razor head, although it is in principle also conceivable to dispose the turning mechanism between the front end of the handle and the razor head.

In order to provide a good guidance and support between the rotating parts, and hence to provide an optimum stability, it is proposed pursuant to a further embodiment that in the region of the turning mechanism, the surfaces of the rotating parts rest flat against one another.

In a first specific embodiment, the axis of rotation of the turning mechanism is disposed i the longitudinal central axis of the handle. In an alternative, second, preferred embodiment, the axis of rotation of the turning mechanism in contrast extends perpendicular to the plane of the razor blade. Optimum shaving results can be achieved in this way.

Pursuant to a further embodiment, it is possible to provide for the razor blade a known razor blade unit that is separate from the razor head and is pivotably disposed on the razor head. In this connection, the razor blade unit can be disposed on the razor head in such a way as to be pivotable not only about an axis that is parallel to the cutting edge but also about an axis that is perpendicular thereto, so that together with the rotatable arrangement of the razor head on the handle, there is provided so to speak a Cardanic or universal support of the razor blade with pivot possibilities about a maximum of three axes.

BRIEF DESCRIPTION OF THE DRAWINGS

Further details and advantages can be derived from the subsequent description of the pertaining drawings, which illustrate two exemplary embodiments of an inventive wet razor. The drawings show.

DESCRIPTION OF PREFERRED EMBODIMENTS

Figure 1:
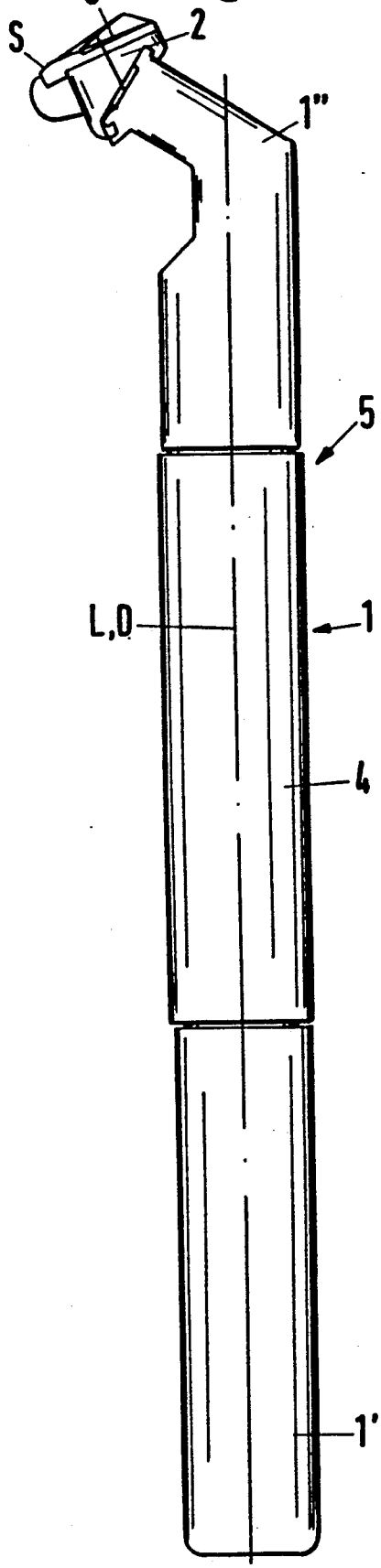
FIG. 1 a schematic side view of a first exemplary embodiment of a wet razor.
Figure 2:
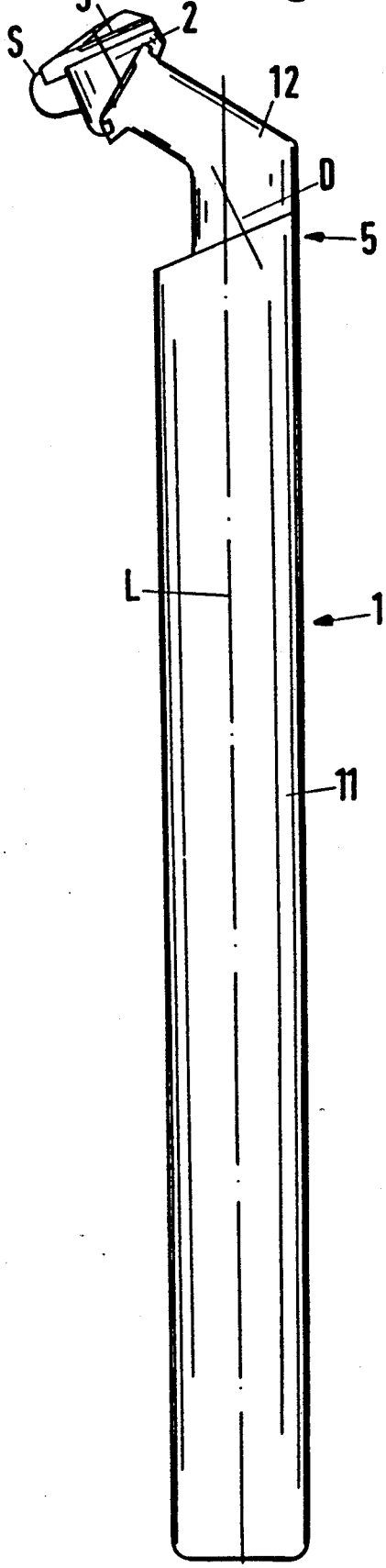
FIG. 2 a schematic side view of a second exemplary embodiment of a wet razor.

Each of the two embodiments of a wet razor illustrated in FIGS. 1 and 2 has a handle 1, at the front end of which is disposed a razor head 2, which can, for example, be inserted thereon. Securely disposed in the razor head 2 is a razor blade 3. In this connection, the plane of the razor blade 3 forms an acute angle with the longitudinal central axis L of the handle 1.

Figure 3:
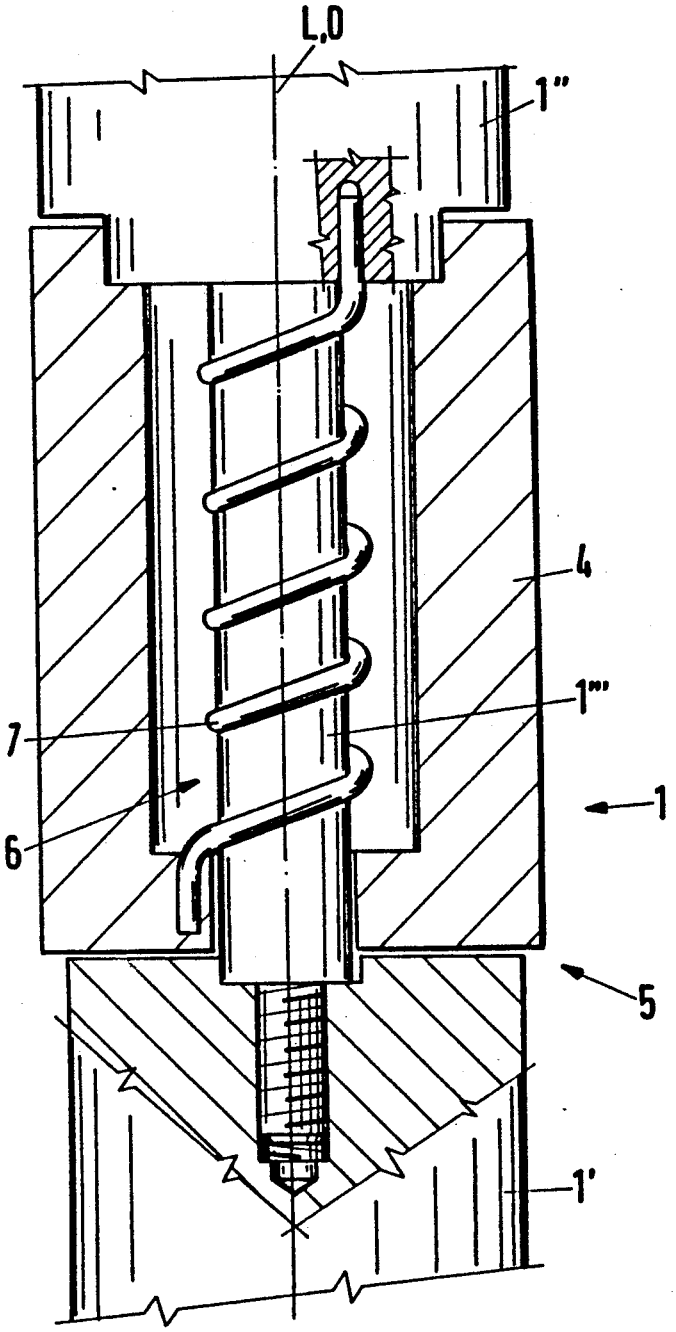
FIG. 3 a partially cross-sectioned detailed view of the first embodiment of FIG. 1 in the region of the turning mechanism.
Figure 4:
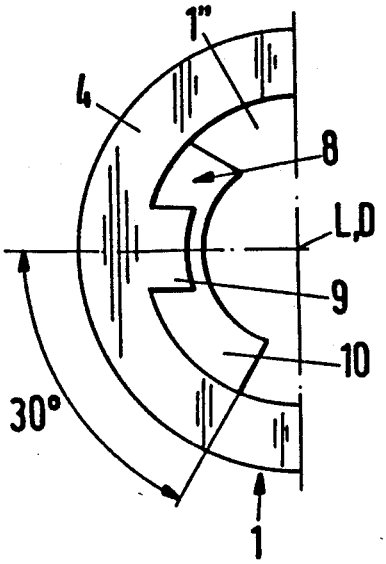
FIG. 4 a schematic section through the turning mechanism of FIG. 3 in the region of the stop arrangement.

In the first embodiment of FIG. 1 as well as the pertaining FIGS. 3 and 4, the handle 1 comprises a rear portion 1' and a front portion 1''. As can be seen from FIG. 3, the bottom end of the front portion 1'' has a connecting rod 1''' onto tightly screwed, so that the rear portion 1' is securely connected to the front portion 1'' via the connecting rod 1'''. In the region of this connecting rod 1''' of the handle 1, a sleeve 4 is rotatably mounted about the longitudinal central axis L of the handle 1. This sleeve 4 forms the grasping portion for the user and defines a turning mechanism 5 via which, when the user firmly grasps the sleeve 4 that defines the grasping portion, the rear portion 1', the connecting rod 1''', the front portion 1'' of the handle 1 together with the razor head 2 and the razor blade 3, can be freely rotated about an axis of rotation D that is perpendicular to the cutting edge S of the razor blade 3, whereby with this embodiment the axis of rotation D of the turning mechanism 5 is disposed in the longitudinal central axis L of the handle 1. In conformity therewith, the plane of rotation is perpendicular to the longitudinal central axis L of the handle 1.

Associated with the turning mechanism 5 is a spring-type returning or resetting mechanism 6 that defines a starting position of the razor. This spring-type resetting mechanism 6 has a spring 7 in the form of a helical spring; this spring surrounds the connecting rod 1''' of the handle 1, and has one end secured in the front portion 1'' of the handle 1 and has the other end secured in the sleeve 4.

In addition, as can be seen in FIG. 4, provided between the front portion 1'' and the sleeve 4 is a stop arrangement 8 that, starting from the starting position, limits the turning movement of the razor head 2 relative to the sleeve 4 by 30° toward both sides. For this purpose, the sleeve 4 is provided with a radially inwardly directed projection or tab 9, and the front portion 1'' of the handle 1 is provided with a recessed portion 10 that is in the shape of part of a ring.

In the alternative embodiment of FIG. 2, the handle 1 comprises the rear grasping portion 11 as well as the front handle portion 12 on which is disposed the razor head 2. Again provided between this grasping portion 11 and the front portion 12 of the handle 1 is a turning mechanism 5. In this connection, the axis of rotation D is inclined relative to the longitudinal central axis L of the handle 1 and in so doing extends essentially perpendicular to the plane of the razor blade 3 that is disposed in the razor head 2. In conformity therewith, the front end of the grasping portion 11 is beveled in the region of the turning mechanism 5 of the handle 1.

The turning mechanism 5 of this second embodiment can be embodied in any suitable manner, for example by rotatably mounting the front handle portion 12 in the grasping portion 11 via a journal or turning pin. Furthermore, a suitable spring-type resetting mechanism is provided.

By disposing the turning mechanism 5 in the handle 1, with both embodiments the razor head 2, and hence the razor blade 3, optimally follow the contour of the face during a shaving process. As a consequence of the turning mechanism 5, the razor head 2 is always correctly aligned without the danger, for example, of tilting or canting. In this connection, the spring-type resetting mechanism 6 prevents too rapid of a deflection and adjustment of the razor head 2 due to the forces of resistance that occur while shaving. Furthermore, the spring-type resetting mechanism 6 ensures that the razor head 2 returns to the defined starting position after it is raised from the surface of the face. The stop arrangement 8, which is provided both with the first embodiment as well as with the second embodiment and limits the pivot angle of the razor head 2 to approximately a plus or minus 30°, prevents a movement component in the direction of the cutting edge S of the razor blade 3, which would lead to injury from cuts.

In the illustrated embodiments, the razor blade 3 is fixedly disposed in the razor head 2. However, instead of this configuration it is also conceivable to provide a so-called razor blade unit where the razor blade is fixedly embedded in a plastic housing that in turn is held on the razor head, for example via a fork-type mounting. In this way, it is additionally possible to mount the razor blade unit on the razor head in such a way that it is pivotable about an axis that is parallel to the cutting edge of the razor blade. Furthermore, it is also conceivable to allow the razor blade unit to pivot about an axis that is perpendicular thereto, so that then there is provided so to speak a Cardanic or universal mounting of the razor blade 3 with optimum adjustment possibilities.

The present invention is, of course, in no way restricted to the specific disclosure of the specification and drawings, but also encompasses any modifications within the scope of the appended claims.

What I claim is:

1. A wet razor having a handle, on a front portion of which is disposed a razor head that carries a razor blade with a cutting edge, said razor further comprising:

a rear handle portion;

a connecting rod that rigidly interconnects said front and rear portions of said handle;

a grasping portion of said handle that is in the form of a sleeve that is disposed about said connecting rod and between said front and rear portions of said handle in such a way as to be freely movable relative thereto and in particular rotatable only relative to said front and rear portions of said handle about an axis of rotation that is perpendicular to said cutting edge of said razor blade;

a resetting mechanism disposed within said sleeve for automatically returning said front and rear portions of said handle, and hence said razor head, to a starting position after limited rotation thereof relative to said sleeve, with said resetting mechanism including a helical spring that surrounds said connecting rod, with said spring having two ends, one of which is connected to said sleeve, and the other of which is connected to said front portion of said handle; and a stop arrangement disposed between said sleeve and said front portion of said handle for effecting said limited travel of said razor head.

2. A wet razor according to claim 1, in which said stop arrangement limits said travel of said razor head, starting from said starting position, to a maximum of about 30° in either direction of rotation.

3. A wet razor according to claim 2, in which said stop arrangement includes a recessed portion, in the shape of part of a ring, in said front portion of said handle, and a tab on said sleeve that projects radially inwardly into said recessed portion.

4. A wet razor according to claim 23, in which said sleeve is essentially disposed in a central portion of said handle.

5. A wet razor according to claim 1, in which in the region of said turning mechanism, surfaces of rotating parts rest flat against one another.

6. A wet razor according to claim 1, in which said axis of rotation of said turning mechanism is disposed in a longitudinal central axis of said handle.

7. A wet razor according to claim 1, in which said axis of rotation of said turning mechanism extends perpendicular to a plane of said razor blade.

8. A wet razor according to claim 1, in which said razor blade is in the form of a razor blade unit that is separate from said razor head and is pivotably disposed thereon.

* * * * *